US005845947A

United States Patent [19]

Arabia, Jr. et al.

[11] Patent Number: 5,845,947

[45] Date of Patent: Dec. 8, 1998

[54] DOOR LATCH LEVER WITH SERVICEABLE ROD RETAINER

[75] Inventors: Frank Joseph Arabia, Jr.; Danielle Elizabeth Arabia, both of Macomb, Mich.

[73] Assignee: General Motors Corporation, Detroit, Mich.

[21] Appl. No.: 390,973

[22] Filed: Feb. 21, 1995

[51] Int. Cl.[6] ..... E05C 19/00

[52] U.S. Cl. ..... 292/1; 292/336.3; 292/DIG. 38; 384/428

[58] Field of Search ..... 292/1, 336.3, DIG. 38, 292/DIG. 53, 307 R, 325, 315, 307 B; 384/295, 428, 439, 10, 42

[56] References Cited

U.S. PATENT DOCUMENTS

| | | | |
|---|---|---|---|
| 3,164,054 | 1/1965 | Biesecker | 85/8.8 |
| 3,720,449 | 3/1973 | Godin | 384/10 |
| 4,299,417 | 11/1981 | McClure | 292/320 |
| 4,750,878 | 6/1988 | Nix et al. | 384/295 X |
| 4,750,886 | 6/1988 | Portelli et al. | 403/163 |
| 4,886,309 | 12/1989 | Shimura | 292/336.3 |
| 5,046,771 | 9/1991 | Dedrich | 292/336.3 |
| 5,074,676 | 12/1991 | Fannon et al. | 384/10 |
| 5,116,091 | 5/1992 | Swift | 292/321 X |
| 5,178,479 | 1/1993 | Brown et al. | 403/13 |
| 5,251,403 | 10/1993 | Compeau et al. | 49/502 |
| 5,388,915 | 2/1995 | Huber | 384/295 X |
| 5,435,609 | 7/1995 | Igata | 292/346 |
| 5,492,379 | 2/1996 | Staser et al. | 292/336.3 |

*Primary Examiner*—Darnell M. Boucher
*Attorney, Agent, or Firm*—Charles E. Leahy

[57] ABSTRACT

The invention relates to a molded plastic lever for a door latch, and more particularly, provides a serviceable retainer bushing for connecting an operating rod to the lever.

3 Claims, 2 Drawing Sheets

DOOR LATCH LEVER WITH SERVICEABLE ROD RETAINER

BACKGROUND OF THE INVENTION

It is well known that door latches include a lever which is pivotally mounted to operate the latch. Such levers can be either a lever which is operated to unlatch the door for opening movement or a lock lever which is operated to lock and unlock the door latch. The lever is controlled by a handle and the handle is connected to the lever by a metal rod. A plastic retainer bushing typically snaps into an aperture in the lever and has a central bore which receives the rod. The bushing typically has spring fingers which carry projections projecting into the bore so that the projections seat within an annular groove of the rod to retain the rod within the retainer bushing.

The prior art has recognized the advantage of manufacturing the lever from molded plastic in order to obtain light weight and economies of manufacture. Furthermore, with a plastic lever, the retainer bushing for the rod can be molded integrally with the lever to provide additional economies of manufacture and assembly.

Although plastic levers can be readily designed to accommodate the forces normally encountered during the operation of the door latch, such levers may be more difficult to service in the vehicle aftermarket because an unskilled repairman may apply excessive force and fracture the plastic lever.

SUMMARY OF THE INVENTION

According to the present invention, the retainer bushing for the rod is integrally molded with the lever but connected thereto by an integrally molded frangible web so that application of excessive force to the rod or bushing will fracture the bushing away from the lever rather than permitting a fracture of the lever. A slot may be provided between the bushing and the lever to receive a tool such as a screwdriver by which the bushing can be translated axially relative to the lever to fracture the frangible web and permit removal of the bushing. The retainer bushing is preferably molded to the lever within the annulus of an annular boss. A shoulder molded within the annulus. The replacement bushing is inserted through the annulus and carries shoulders which project into engagement with the shoulders of the annulus to thereby retain the replacement bushing within the annular boss of the lever.

DESCRIPTION OF THE PREFERRED EMBODIMENT

Figure 1:
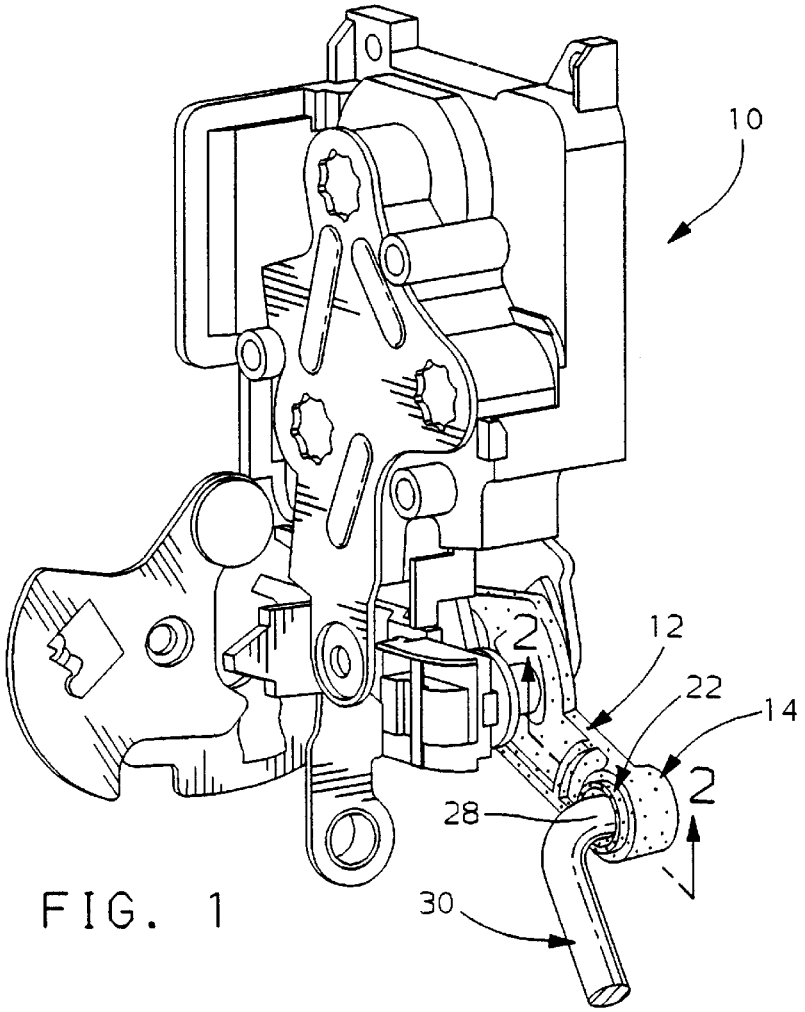
FIG. 1 is a perspective view of a door latch having a plastic operating lever according to the invention.

Referring to FIG. 1 there is shown a vehicle door latch 10 having a operating lever 12 which rotates about a pivot, not shown, to lock and unlock the door latch. The lever 12 is of molded plastic construction and includes an integrally molded annular boss 14 at the end thereof opposite the pivot.

Figure 2:
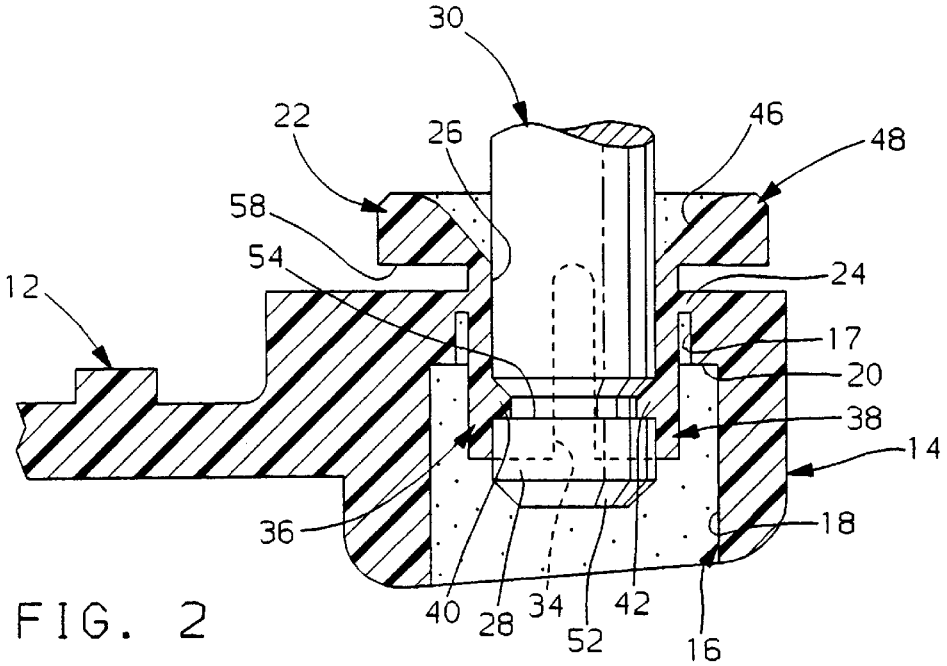
FIG. 2 is a section view taken in the direction of arrows 2—2 of FIG. 1.

As best seen in FIG. 2, the annular boss 14 has a stepped bore 16 including an upper small bore 17 and lower large bore 18 which define a downwardly facing shoulder 20. A plastic retainer bushing 22 is molded integrally to the lever 12 within the stepped bore 18 of annular boss 14. The integrally molded connection between the annular boss 14 and the retainer bushing 22 is provided by an integral frangible web 24 of the molded plastic material.

Figure 3:
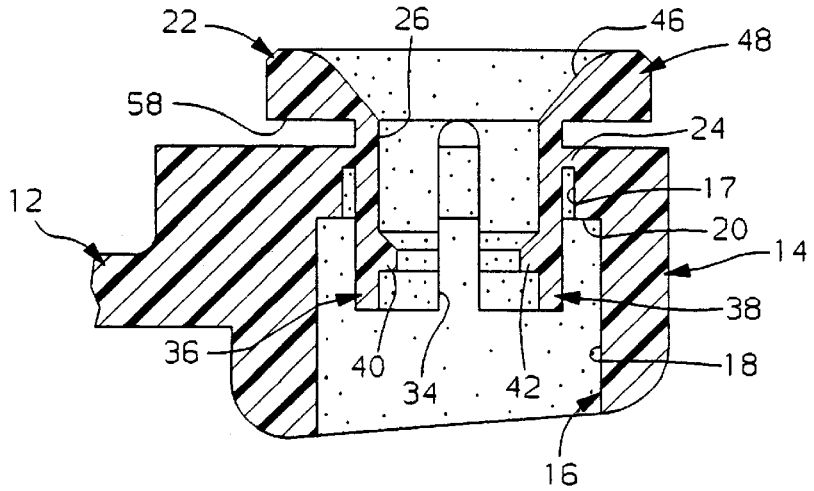
FIG. 3,is an elevation view of the integrally molded plastic retainer bushing.

The retainer bushing 22 has a central bore 26 which receives the end 28 of a door lock rod 30. As best seen in FIG. 3, the retainer bushing 22 has a plurality of slots, one of which is shown at 34, to divide the retainer bushing into opposed flexible fingers 36 and 38. The flexible fingers respectively carry locking projections 40 and 42 which project into the bore 26. As best seen in FIG. 2, the rod end 28 can be thrust into the bore 26 of the retainer as facilitated by tapered entry walls 46 provided in the head portion 48 of the retainer bushing 22. The rod end 28 is chamfered at 52 so that insertion of the rod causes the flexible fingers 36 and 38 to be deflected outwardly. The rod end 28 has a circumferential groove 54 thereon which receives the projections 40 and 42 in snap-fitting fashion when the rod end 28 is inserted to the position of FIG. 2. Accordingly, it is understood that the retainer bushing 22 effectively connects the rod 30 to the lever 12 in a manner permitting relative rotation between the rod 30 and the lever 12.

Figure 4:
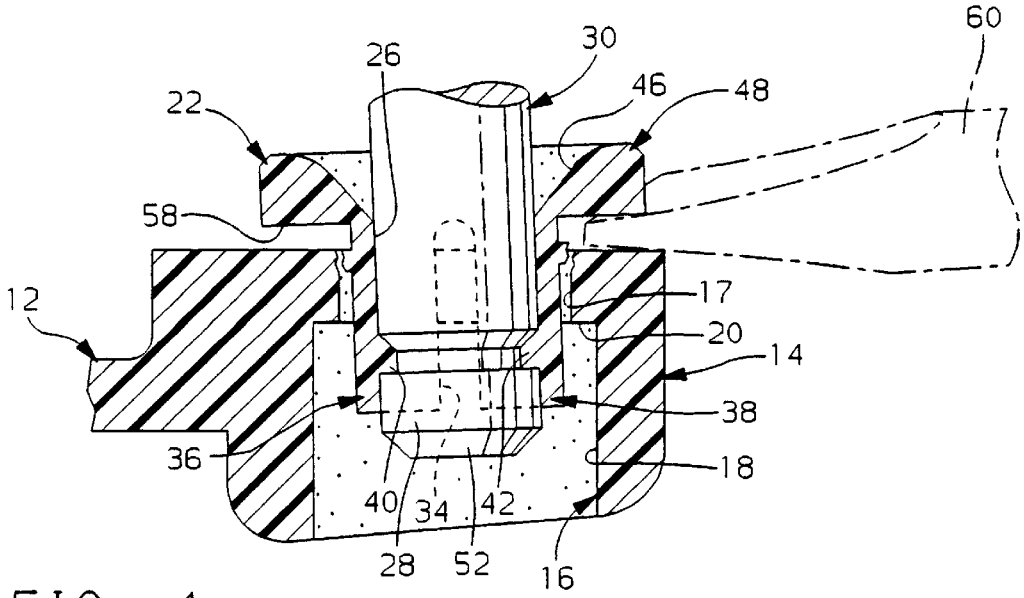
FIG. 4 s a view similar to FIG. 3 but showing the use o,a tool to fracture the retainer bushing away from the lever.

As best seen by reference to FIG. 4, the head portion 48 of the retainer bushing 22 is spaced axially somewhat away from the annular boss 14 to define a circumferential extending slot 58. A tool, such as the screwdriver 60 shown in FIG. 4 may be seated in the slot 58 and then twisted to cause axial shifting of the retainer bushing 22 within the stepped bore 16 of the annular boss 14. This shifting movement works to fracture the frangible web 24 so that the rod 30 and the retainer bushing 22 is detached from the lever 12. This operation may be performed by the repairman in the event that the vehicle door must be disassembled.

In the event that an inexperienced operator attempts to forcibly pull the rod end 28 out of the retainer 22, the frangible web 24 will fracture and permit the entire bushing to be removed with the rod.

After the rod 30 is separated from the plastic lever 12 by fracture of the frangible web, pliers or other tools can be used to completely fracture the retainer bushing 22 away from the rod end 28.

Figure 5:
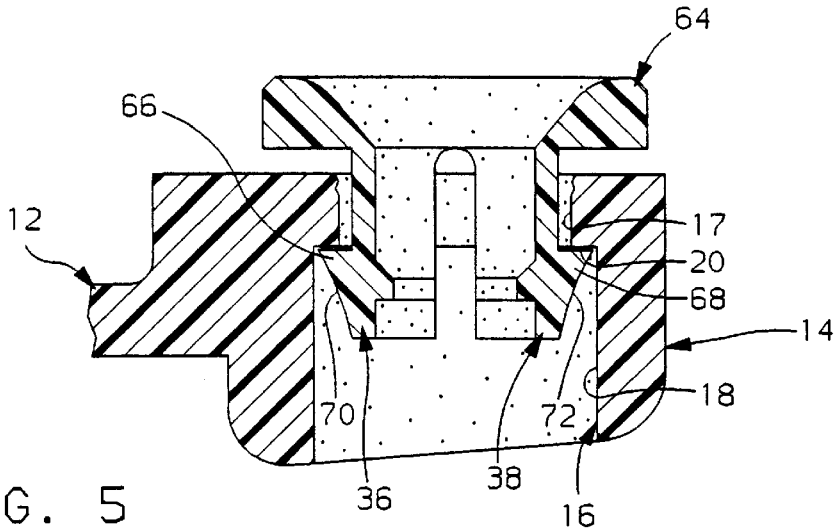
FIG. 5 is a view similar to FIGS. 3 and 4 but showing the installation of a replacement bushing into the lever.

As seen in FIG. 5, a replacement retainer bushing 64 is similar in shape to the integrally molded bushing except that the flexible fingers 36 and 38 are provided with locking projections 66 and 68 on the outer circumfery thereof. The underside of these locking projections 66 and 68 is tapered as at 70 and 72 so that flexible fingers 36 and 38 flex inwardly when the replacement retainer bushing 64 is thrust downwardly into the stepped bore 16 of the annular boss 14. Upon full insertion of the replacement retainer bushing, the flexible fingers 36 and 38 return outwardly to their normal unflexed position of FIG. 5, in which the locking shoulders 66 and 68 have become seated beneath the shoulder 20 of the stepped bore 16.

Referring to FIG. 5, it is seen that the operating rod 30 will be reconnected to the latch lever by a replacement retainer bushing generally indicated at 64. This retainer bushing has an interior which is identical to that of the integral retainer bushing 22 of FIG. 2 so as to provide snap fitting retention of the rod end therein.

Thus, it is seen that the invention provides a new and improved serviceable operating lever for a door latch.

The embodiments of the invention in which an exclusive property or privilege is claimed are defined as follows:

1. In a vehicle latch assembly of the type in which a molded plastic operating lever is shifted by an operating rod having a circumferential groove thereon, the improvement comprising:

said operating lever having a bushing portion integrally molded in one piece continuous molded together construction with the molded plastic lever and having a bore for receiving the rod, retaining fingers molded integral with the bushing portion and projecting into the bore to grip the circumferential groove of the rod, a frangible web molded integral in connection between the bushing portion and the lever so that the lever predeterminately fractures at the frangible web in the event of excessive force application to the lever upon attempted disassembly of the rod from the bushing.

2. In a vehicle latch assembly of the type in which a molded plastic operating lever is shifted by an operating rod having a circumferential groove thereon, the improvement comprising:

said operating lever having a bushing portion integrally molded in one piece continuous molded together construction with the molded plastic lever and having a bore for receiving the rod, retaining fingers molded integral with the bushing portion and projecting into the bore to seat within the circumferential groove of the rod, a frangible web molded integral in connection between the bushing portion and the lever, and a slot between the bushing portion and the lever adapted to receive a tool by which the bushing portion can be translated axially within the bore relative to the lever to fracture the frangible web and permit removal of the bushing and subsequent replacement of the bushing by a replacement bushing.

3. In a vehicle latch assembly of the type in which a molded plastic operating lever is shifted by an operating rod having a circumferential groove thereon, the improvement comprising:

said operating lever having an annular boss at the end of the lever, a bushing portion integrally molded in one piece continuous molded together construction with the molded plastic lever and within the annular boss and having a bore for receiving the rod, retaining fingers molded integral with the bushing portion and projecting into the bore to grip the circumferential groove of the rod, a frangible web molded integral in connection between the bushing portion and the lever, a slot between the bushing portion and the lever adapted to receive a tool by which the bushing portion can be translated axially relative to the lever to fracture the frangible web and permit removal of the bushing, and a replacement bushing adapted to snap-fit within the annular boss to permit the reinstallation of the rod to the lever by insertion of the rod into the replacement bushing.

* * * * *